US009006156B2

(12) United States Patent
Saccomando et al.

(10) Patent No.: US 9,006,156 B2
(45) Date of Patent: Apr. 14, 2015

(54) IMIDES AND BIS-IMIDES AS FRICTION MODIFIERS IN LUBRICANTS

(75) Inventors: Daniel J. Saccomando, Sheffield (GB); Richard J. Vickerman, Stow, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 753 days.

(21) Appl. No.: 13/319,349

(22) PCT Filed: May 10, 2010

(86) PCT No.: PCT/US2010/034163

§ 371 (c)(1), (2), (4) Date: Jan. 25, 2012

(87) PCT Pub. No.: WO2010/132318

PCT Pub. Date: Nov. 18, 2010

(65) Prior Publication Data

US 2012/0122744 A1 May 17, 2012

Related U.S. Application Data

(60) Provisional application No. 61/177,734, filed on May 13, 2009.

(51) Int. Cl.

| | |
|---|---|
| ***C10M 141/10*** | (2006.01) |
| ***C10M 169/04*** | (2006.01) |
| ***C10M 133/16*** | (2006.01) |

(52) U.S. Cl.

CPC ..... *C10M 133/16* (2013.01); *C10M 2201/085* (2013.01); *C10M 2203/1006* (2013.01); *C10M 2215/064* (2013.01); *C10M 2215/08* (2013.01); *C10M 2215/086* (2013.01); *C10M 2215/28* (2013.01); *C10M 2223/049* (2013.01); *C10M 2227/061* (2013.01); *C10N 2230/06* (2013.01); *C10N 2240/045* (2013.01)

(58) Field of Classification Search

USPC ..... 508/162, 291, 555

See application file for complete search history.

(56) References Cited

U.S. PATENT DOCUMENTS

| | | | |
|---|---|---|---|
| 3,251,853 | A | 5/1966 | Hoke et al. |
| 4,237,022 | A | 12/1980 | Barrer et al. |
| 4,446,038 | A | 5/1984 | Schlicht et al. |
| 4,741,848 | A | 5/1988 | Koch et al. |
| 4,789,493 | A | 12/1988 | Horodysky et al. |
| 2006/0183647 | A1 | 8/2006 | Kocsis et al. |
| 2009/0005277 | A1 | 1/2009 | Watts et al. |

FOREIGN PATENT DOCUMENTS

| | | |
|---|---|---|
| WO | 2010/132229 | 11/2010 |
| WO | 2010/132320 | 11/2010 |

OTHER PUBLICATIONS

Corresponding PCT Publication & Search Report No. WO 2010/132318 A1 published Nov. 18, 2010.

Written Opinion from corresponding International Application No. PCT/US2010/034163 dated Jul. 29, 2010.

*Primary Examiner* — Vishal Vasisth

(74) *Attorney, Agent, or Firm* — David M. Shold, Esq.; Teresan W. Gilbert, Esq.

(57) ABSTRACT

A composition is provided for use as a friction modifier for an automatic transmission, which comprises a condensation product of a hydroxypolycarbox-ylic acid, such as 2,3-dihydroxybutanedioic acid or 2-hydroxybutanedioic acid, with an N,N-di(hydrocarbyl)alkylenediamine, where each hydrocarbyl group contains 1 to 22 carbon atoms, provided that the total number of carbon atoms in the two hydrocarbyl groups is at least about 9, and the alkylene group contains 2 to 4 carbon atoms.

8 Claims, No Drawings

IMIDES AND BIS-IMIDES AS FRICTION MODIFIERS IN LUBRICANTS

BACKGROUND OF THE INVENTION

The present technology relates to the field of additives for fluids such as automatic transmission fluids, traction fluids, fluids for continuously variable transmission fluids (CVTs), dual clutch automatic transmission fluids, farm tractor fluids, engine lubricants industrial gear lubricants, greases, and hydraulic fluids.

In the automatic transmission marketplace, where there is rapid engineering change driven by the desire to reduce weight and increase transmission capacity, there is a desire for automatic transmission fluids that exhibit a high static coefficient of friction for improved clutch holding capacity. Continuously slipping torque converter clutches, for instance, impose exacting friction requirements on automatic transmission fluids (ATFs). The fluid must have a good friction versus sliding speed relationship, or an objectionable phenomenon called shudder will occur in the vehicle. Transmission shudder is a self-excited vibrational state commonly called "stick-slip" or "dynamic frictional vibration" generally occurring in slipping torque converter clutches. The friction characteristics of the fluid and material system, combined with the mechanical design and controls of the transmission, determine the susceptibility of the transmission to shudder. Plotting the measured coefficient of friction (g) versus sliding speed (V), commonly called a μL-V curve, has been shown to correlate to transmission shudder. Both theory and experiments support the region of positive to slightly negative slope of this μL-V curve to correlate to good anti-shudder performance of transmission fluids. A fluid which allows the vehicle to operate without vibration or shudder is said to have good "anti-shudder" performance. The fluid should maintain those characteristics over its service lifetime. The longevity of the anti-shudder performance in the vehicle is commonly referred to as "anti-shudder durability". The variable speed friction tester (VSFT) measures the coefficient of friction with respect to sliding speed simulating the speeds, loads, and friction materials found in transmission clutches and correlates to the performance found in actual use. The procedures are well documented in the literature; see for example Society of Automotive Engineers publication #941883.

The combined requirements of high static coefficient of friction and durable positive slope are often incompatible with traditional ATF friction modifier technology which is extremely well described in the patent literature. Many of the commonly used friction modifiers result in a low static coefficient of friction and are not durable enough on positive slope to be of sufficient use.

U.S. Pat. No. 4,237,022, Barrer, Dec. 2, 1980, discloses tartarimides and lubricants and fuels containing the same. In an example (IX), an automatic transmission fluid is reported containing the reaction product of tartaric acid with Armeen O (essentially oleylamine).

U.S. Patent Application 2006/0183647, Kocsis et al., Aug. 16, 2006, discloses tartrates, tartrimides, tartramides or combinations thereof useful as additives for lubricants. Various compositions including automatic transmission fluids are said to benefit therefrom. Among the materials disclosed are oleyl tartimide and tridecylpropoxyamine tartrimide. The alkyl groups of the amines may be linear or branched.

U.S. Pat. No. 4,789,493, Horodysky, Dec. 6, 1988, discloses lubricants containing N-alkylalkylenediamine amides. Disclosed is $R^2$—N($R^3$)—$R^1$—NH—$R^3$ wherein $R^1$ is a $C_2$ to $C_4$ alkylene group, $R^2$ must be a $C_{12}$ to $C_{30}$ hydrocarbyl group, and $R^3$ is H, a $C_1$-$C_3$ aliphatic group, or $R^4$—C(═O)—; at least one of the $R^3$s must be $R^4$—C(═O)—. $R^4$ is H or $C_{1-4}$. An example is Coco-NH—$(CH_2)_3$—NH—C(═O)H.

U.S. Pat. No. 3,251,853, Hoke, May 17, 1966, discloses an oil-soluble acylated amine. In examples, reactants can xylyl-stearic acid or heptylphenyl-heptanoic acid, with tetraethylene pentamine or dodecylamine or N-2-aminoethyleoctadecylamine. An example is the condensation product of N-2-aminoethyl)octadecylamine with xylyl-stearic acid.

U.S. Patent publication 2009/0005277, Watts et al., Jan. 1, 2009, discloses lubricating oil compositions said to have excellent friction stability, comprising, among other components, a polyalkylene polyamine-based friction modifier that has been reacted with an acylating agent to convert at least one secondary amine group into an amide.

The disclosed technology, therefore, provides a friction modifier suitable for providing an automatic transmission fluid with a high coefficient of friction or a durable positive slope in a μ-V curve or both.

SUMMARY OF THE INVENTION

The disclosed technology provides a composition comprising a condensation product of a hydroxyl-polycarboxylic acid or mixtures thereof or a reactive equivalent thereof, with an N,N-di(hydrocarbyl)alkylenediamine, where each hydrocarbyl group independently comprises 1 to 22 carbon atoms, provided that the total number of carbon atoms in the two hydrocarbyl groups is at least 9 and the alkylene group contains 2 to 4 carbon atoms. The composition is suitable for use as a friction modifier for an automatic transmission.

The composition, which may be a lubricant, may further comprise an oil of lubricating viscosity and may comprise one or more further additives. It may be used in a method for lubricating an automatic transmission comprising supplying the lubricant thereto.

DETAILED DESCRIPTION OF THE INVENTION

Various features and embodiments will be described below by way of non-limiting illustration.

One component which is used in certain embodiments of the disclosed technology is an oil of lubricating viscosity, which can be present in a major amount, for a lubricant composition, or in a concentrate forming amount, for a concentrate. Suitable oils include natural and synthetic lubricating oils and mixtures thereof. In a fully formulated lubricant, the oil of lubricating viscosity is generally present in a major amount (i.e. an amount greater than 50 percent by weight). Typically, the oil of lubricating viscosity is present in an amount of 75 to 95 percent by weight, and often greater than 80 percent by weight of the composition.

Natural oils useful in making the inventive lubricants and functional fluids include animal oils and vegetable oils as well as mineral lubricating oils such as liquid petroleum oils and solvent-treated or acid-treated mineral lubricating oils of the paraffinic, naphthenic or mixed paraffinic/-naphthenic types which may be further refined by hydrocracking and hydrofinishing processes.

Synthetic lubricating oils include hydrocarbon oils and halo-substituted hydrocarbon oils such as polymerized and interpolymerized olefins, also known as polyalphaolefins; polyphenyls; alkylated diphenyl ethers; alkyl- or dialkylbenzenes; and alkylated diphenyl sulfides; and the derivatives, analogs and homologues thereof. Also included are alkylene oxide polymers and inter-polymers and derivatives thereof, in which the terminal hydroxyl groups may have been modified by esterification or etherification. Also included are esters of dicarboxylic acids with a variety of alcohols, or esters made from C5 to C12 monocarboxylic acids and polyols or polyol ethers. Other synthetic oils include silicon-based oils, liquid esters of phosphorus-containing acids, and polymeric tetrahydrofurans.

Unrefined, refined and rerefined oils, either natural or synthetic, can be used in the lubricants of the present technology (that is, of the presently disclosed technology). Unrefined oils are those obtained directly from a natural or synthetic source without further purification treatment. Refined oils have been further treated in one or more purification steps to improve one or more properties. They can, for example, be hydrogenated, resulting in oils of improved stability against oxidation.

In one embodiment, the oil of lubricating viscosity is an API Group I, Group II, Group III, Group IV, or Group V oil, including a synthetic oil, or mixtures thereof. In another embodiment, the oil is Groups II, III, IV, or V. These are classifications established by the API Base Oil Interchangeability Guidelines. Group III oils contain <0.03 percent sulfur and >90 percent saturates and have a viscosity index of >120. Group II oils have a viscosity index of 80 to 120 and contain <0.03 percent sulfur and >90 percent saturates. Polyalphaolefins are categorized as Group IV. The oil can also be an oil derived from hydroisomerization of wax such as slack wax or a Fischer-Tropsch synthesized wax. Such "Gas-to-Liquid" oils are typically characterized as Group III. Group V is encompasses "all others" (except for Group I, which contains >0.03% S and/or <90% saturates and has a viscosity index of 80 to 120).

In one embodiment, at least 50% by weight of the oil of lubricating viscosity is a polyalphaolefin (PAO). Typically, the polyalphaolefins are derived from monomers having from 4 to 30, or from 4 to 20, or from 6 to 16 carbon atoms. Examples of useful PAOs include those derived from 1-decene. These PAOs may have a viscosity of 1.5 to 150 $mm^2/s$ (cSt) at 100° C. PAOs are typically hydrogenated materials.

The oils of the present technology can encompass oils of a single viscosity range or a mixture of high viscosity and low viscosity range oils. In one embodiment, the oil exhibits a 100° C. kinematic viscosity of 1 or 2 to 8 or 10 $mm^2/sec$ (cSt). The overall lubricant composition may be formulated using oil and other components such that the viscosity at 100° C. is 1 or 1.5 to 10 or 15 or 20 $mm^2/sec$ and the Brookfield viscosity (ASTM-D-2983) at −40° C. is less than 20 or 15 Pa-s (20,000 cP or 15,000 cP), such as less than 10 Pa-s, even 5 or less.

The present technology provides, as one component, a condensation product of a hydroxy-polycarboxylic acid or mixtures thereof or a reactive equivalent thereof with an N,N-di(hydrocarbyl)alkylenediamine, where each hydrocarbyl group independently comprises 1 to 22 carbon atoms, provided that the total number of carbon atoms in the two hydrocarbyl groups of the dihydrocarbylalkylenediamine is at least 9, or alternatively at least 13, and the alkylene group contains 2 to 4 carbon atoms. In certain embodiments, each hydrocarbyl group independently comprises 8 to 22 carbon atoms. In one embodiment this materials does not contain a primary amino group. This material is useful as a friction modifier, particularly for lubricating automatic transmissions.

One example of a hydroxy-polycarboxylic acid is 2-3-dihydroxybutanedioic acid, which is also known as tartaric acid. Another example is 2-hydroxybutanedioic acid, which is also known as malic acid. Yet another example is 2-hydroxypropane-1,2,3-tricarboxylic acid, which is also known as citric acid. Certain of these materials have one or more chiral centers, and either the natural forms or other forms may be used. Thus, the tartaric acid may be L-tartaric acid, D-tartaric acid, DL-tartaric acid, or meso-tartaric acid. The malic acid may be L-malic acid, D-malic acid, or DL-malic acid. Reactive equivalents of these acids include materials that may form condensation products with amines by the appropriate reaction. Examples include anhydrides, esters, and acid halides such as chlorides. In certain embodiments, the hydroxy-polycarboxylic acid comprises 2,3-dihydroxybutanedioic acid or 2-hydroxybutanedioic acid or mixtures thereof or a reactive equivalent of either such acid.

In certain embodiments, the condensation products of the present technology may be represented by the formulas

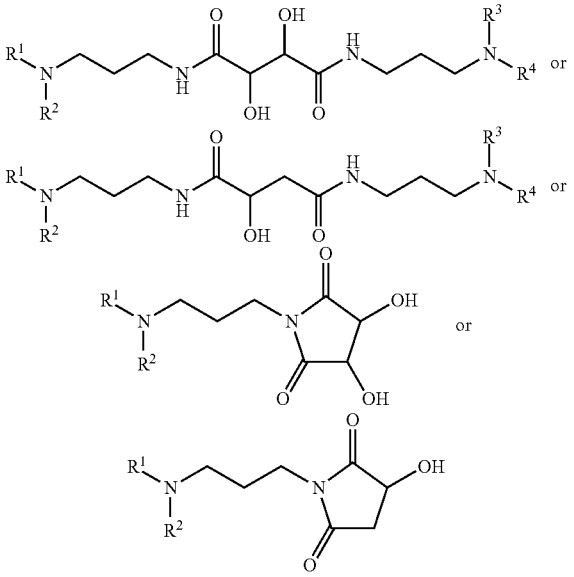

or mixtures thereof; wherein each of $R^1$, $R^2$, $R^3$, and $R^4$ is independently a hydrocarbyl group, such as an alkyl group, of 1 to 22 atoms, provided that the total number of carbon atoms in $R^1$ and $R^2$ is at least about 9 or at least about 13, and provided that the total number of carbon atoms in $R^3$ and $R^4$ is at least about 9 or at least about 13. In certain embodiments, each of $R^1$, $R^2$, $R^3$, and $R^4$ is independently a hydrocarbyl group, such as an alkyl group, of 8 to 22 atoms. The hydrocarbyl or alkyl groups may be the same or different within a given molecule or within a mixture of molecules in the overall composition.

In certain embodiments, the hydrocarbyl groups may comprise a mixture of individual groups on the same or different molecules having a variety of carbon numbers falling generally within the range of 8 to 22 or 12 to 22 or 12 to 20 or 12 to 20 carbon atoms, although molecules with hydrocarbyl groups falling outside this range may also be present. If a mixture of hydrocarbyl groups is present, they may be primarily of even carbon number (e.g., 12, 14, 16, 18, 20, or 22) as is characteristic of groups derived from many naturally-occurring materials, or they may be a mixture of even and odd carbon numbers or, alternatively, an odd carbon number or a mixture of odd numbers. They may be branched, linear, or cyclic and may be saturated or unsaturated, or combinations thereof. In certain embodiments the hydrocarbyl groups may contain 16 to 18 carbon atoms, and sometimes predominantly 16 or predominantly 18. Specific examples include mixed "coco" groups from cocoamine (predominantly C12 and C14 amines) and mixed "tallow" groups from tallowamine (predominantly C16 and C18 groups), isostearyl groups, and 2-ethylhexyl groups.

Diamines suitable for preparing such products include those in the Duomeen™ series, available from Akzo, having a general structure such as

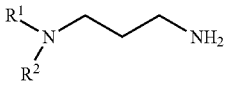

Such polyamines may be prepared by the addition of the monoamine $R^1R^2NH$ to acrylonitrile, to prepare the alkyl nitrile amine (cyanoalkyl amine),

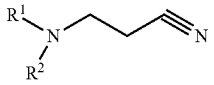

followed by catalytic reduction of the nitrile group using, e.g., $H_2$ over Pd/C catalyst, to give the diamine.

Some specific examples of the materials of the disclosed technology include those represented by the following structures:

(I)

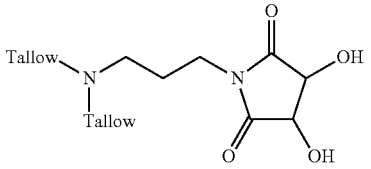

(II)

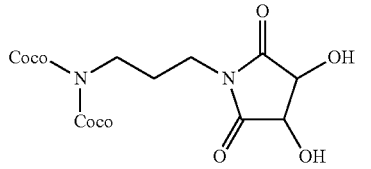

(III)

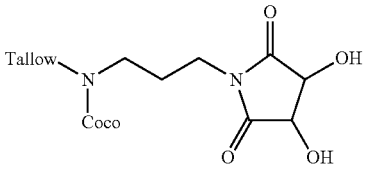

(IV)

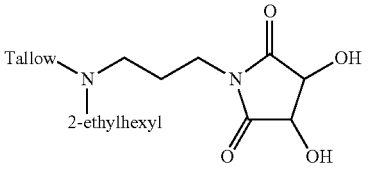

where coco and tallow are as defined above. Each of these materials has been drawn in the tartrimide structure, but it is to be understood that the corresponding diamides are also contemplated. In the diamides, the two individual amine components may be the same or different. Also, the corresponding malimides and malic diamides are also contemplated.

The amount of the condensation product in a fully formulated lubricant may be 0.05 to 10 percent by weight, or 0.1 to 10 percent, or 0.5 to 6 percent or 0.8 to 4 percent, or 1 to 2.5 percent Other components may be present. One such component is a dispersant. It may be described as "other than an amine compound as described above" in the event that some of the amine compounds described above may exhibit some dispersant characteristics. Examples of "carboxylic dispersants" are described in many U.S. patents including the following: U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235.

Succinimide dispersants, a species of carboxylic dispersants, are prepared by the reaction of a hydrocarbyl-substituted succinic anhydride (or reactive equivalent thereof, such as an acid, acid halide, or ester) with an amine, as described above. The hydrocarbyl substituent group generally contains an average of at least 8, or 20, or 30, or 35 up to 350, or to 200, or to 100 carbon atoms. In one embodiment, the hydrocarbyl group is derived from a polyalkene. Such a polyalkene can be characterized by an $\overline{M}_n$ (number average molecular weight) of at least 500. Generally, the polyalkene is characterized by an $\overline{M}_n$ of 500, or 700, or 800, or 900 up to 5000, or to 2500, or to 2000, or to 1500. In another embodiment $\overline{M}_n$ varies from 500, or 700, or 800, to 1200 or to 1300. In one embodiment the polydispersity ($\overline{M}_w/\overline{M}_n$) is at least 1.5.

The polyalkenes include homopolymers and inter-polymers of polymerizable olefin monomers of 2 to 16 or to 6, or to 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the inter-polymer is a homopolymer. An example of a polymer is a polybutene. In one instance about 50% or at least 50% of the polybutene is derived from isobutylene. The polyalkenes can be prepared by conventional procedures.

In one embodiment, the succinic acylating agents are prepared by reacting a polyalkene with an excess of maleic anhydride to provide substituted succinic acylating agents wherein the number of succinic groups for each equivalent weight of substituent group is at least 1.3, e.g., 1.5, or 1.7, or 1.8. The maximum number of succinic groups per substituent group generally will not exceed 4.5, or 2.5, or 2.1, or 2.0. The preparation and use of substituted succinic acylating agents wherein the substituent is derived from such polyolefins are described in U.S. Pat. No. 4,234,435.

The substituted succinic acylating agent can be reacted with an amine, including those amines described above and heavy amine products known as amine still bottoms. The amount of amine reacted with the acylating agent is typically an amount to provide a mole ratio of CO:N of 1:2 to 1:0.25, or 1:2 to 1:0.75. If the amine is a primary amine, complete condensation to the imide can occur. Varying amounts of amide product, such as the amidic acid, may also be present. If the reaction is, rather, with an alcohol, the resulting dispersant will be an ester dispersant. If both amine and alcohol functionality are present, whether in separate molecules or in the same molecule (as in the above-described condensed amines), mixtures of amide, ester, and possibly imide functionality can be present. These are the so-called ester-amide dispersants.

"Amine dispersants" are reaction products of relatively high molecular weight aliphatic or alicyclic halides and amines, such as polyalkylene polyamines. Examples thereof are described in the following U.S. Pat. Nos. 3,275,554, 3,438,757, 3,454,555, and 3,565,804.

"Mannich dispersants" are the reaction products of alkyl phenols in which the alkyl group contains at least 30 carbon atoms with aldehydes (especially formaldehyde) and amines (especially polyalkylene polyamines). The materials described in the following U.S. patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

Post-treated dispersants are also part of the present technology. They are generally obtained by reacting carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds such as boric acid (to give "borated dispersants"), phosphorus compounds such as phosphorus acids or anhydrides, or 2,5-dimercaptothiadiazole (DMTD). Exemplary materials of this kind are described in the following U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

Mixtures of dispersants can also be used. The amount of dispersant or dispersants, if present in formulations of the present technology, is generally 0.3 to 10 percent by weight. In other embodiments, the amount of dispersant is 0.5 to 7 percent or 1 to 5 percent of the final blended fluid formulation. In a concentrate, the amounts will be proportionately higher.

Another component frequently used is a viscosity modifier. Viscosity modifiers (VM) and dispersant viscosity modifiers (DVM) are well known. Examples of VMs and DVMs may include polymethacrylates, polyacrylates, polyolefins, styrene-maleic ester copolymers, and similar polymeric substances including homopolymers, copolymers and graft copolymers. The DVM may comprise a nitrogen-containing methacrylate polymer, for example, a nitrogen-containing methacrylate polymer derived from methyl methacrylate and dimethylaminopropyl amine.

Examples of commercially available VMs, DVMs and their chemical types may include the following: polyisobutylenes (such as Indopol™ from BP Amoco or Parapol™ from ExxonMobil); olefin copolymers (such as Lubrizol™ 7060, 7065, and 7067 from Lubrizol and Lucant™ HC-2000L and HC-600 from Mitsui); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series of viscosity index improver from Afton, and LZ 7702™, LZ 7727™, LZ 7725™ and LZ 7720C™ from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Also included are Asteric™ polymers from Lubrizol (methacrylate polymers with radial or star architecture). Viscosity modifiers that may be used are described in U.S. Pat. Nos. 5,157,088, 5,256,752 and 5,395,539. The VMs and/or DVMs may be used in the functional fluid at a concentration of up to 20% by weight. Concentrations of 1 to 12%, or 3 to 10% by weight may be used.

Another component that may be used in the composition used in the present technology is a supplemental friction modifier. These friction modifiers are well known to those skilled in the art. A list of friction modifiers that may be used is included in U.S. Pat. Nos. 4,792,410, 5,395,539, 5,484,543 and 6,660,695. U.S. Pat. No. 5,110,488 discloses metal salts of fatty acids and especially zinc salts, useful as friction modifiers. A list of supplemental friction modifiers that may be used may include:

| |
|---|
| fatty phosphites |
| fatty acid amides |
| fatty epoxides |
| borated fatty epoxides |
| fatty amines other than the fatty amines discussed above |
| glycerol esters |
| borated glycerol esters |
| alkoxylated fatty amines |
| oxazolines |
| hydroxyalkyl amides |
| dialkyl tartrates |
| borated alkoxylated fatty amines |
| metal salts of fatty acids |
| sulfurized olefins |
| fatty imidazolines |
| condensation products of carboxylic acids and polyalkylene-polyamines |
| metal salts of alkyl salicylates |
| amine salts of alkylphosphoric acids |
| ethoxylated alcohols |
| imidazolines |
| polyhydroxy tertiary amines |
| molybdenum compounds |
| and mixtures of two or more thereof. |

Representatives of each of these types of friction modifiers are known and are commercially available. For instance, fatty phosphites may be generally of the formula $(RO)_2PHO$ or (RO)(HO)PHO where R may be an alkyl or alkenyl group of sufficient length to impart oil solubility. Suitable phosphites are available commercially and may be synthesized as described in U.S. Pat. No. 4,752,416.

Borated fatty epoxides that may be used are disclosed in Canadian Patent No. 1,188,704. These oil-soluble boron-containing compositions may be prepared by reacting a boron source such as boric acid or boron trioxide with a fatty epoxide which may contain at least 8 carbon atoms. Non-borated fatty epoxides may also be useful as supplemental friction modifiers.

Borated amines that may be used are disclosed in U.S. Pat. No. 4,622,158. Borated amine friction modifiers (including borated alkoxylated fatty amines) may be prepared by the reaction of a boron compounds, as described above, with the corresponding amines, including simple fatty amines and hydroxy containing tertiary amines. The amines useful for preparing the borated amines may include commercial alkoxylated fatty amines known by the trademark "ETHOMEEN" and available from Akzo Nobel, such as bis[2-hydroxyethyl]-coco-amine, polyoxyethylene[10]cocoamine, bis[2-hydroxyethyl]soyamine, bis[2-hydroxyethyl]-tallowamine, polyoxyethylene-[5]tallowamine, bis[2-hydroxyethyl]oleyl-amine, bis[2-hydroxyethyl]-octadecylamine, and polyoxyethyl-ene[15]octadecylamine. Such amines are described in U.S. Pat. No. 4,741,848.

Alkoxylated fatty amines and fatty amines themselves (such as oleylamine) may be useful as friction modifiers. These amines are commercially available.

Both borated and unborated fatty acid esters of glycerol may be used as friction modifiers. Borated fatty acid esters of glycerol may be prepared by borating a fatty acid ester of glycerol with a boron source such as boric acid. Fatty acid esters of glycerol themselves may be prepared by a variety of methods well known in the art. Many of these esters, such as glycerol monooleate and glycerol tallowate, are manufactured on a commercial scale. Commercial glycerol monooleates may contain a mixture of 45% to 55% by weight monoester and 55% to 45% by weight diester.

Fatty acids may be used in preparing the above glycerol esters; they may also be used in preparing their metal salts, amides, and imidazolines, any of which may also be used as friction modifiers. The fatty acids may contain 6 to 24 carbon atoms, or 8 to 18 carbon atoms. A useful acid may be oleic acid. The amides of fatty acids may be those prepared by condensation with ammonia or with primary or secondary amines such as diethylamine and diethanolamine. Fatty imidazolines may include the cyclic condensation product of an acid with a diamine or polyamine such as a polyethylenepolyamine. In one embodiment, the friction modifier may be the condensation product of a C8 to C24 fatty acid with a polyalkylene polyamine, for example, the product of isostearic acid with tetraethylenepentamine. The condensation products of carboxylic acids and polyalkyleneamines may be imidazolines or amides.

The fatty acid may also be present as its metal salt, e.g., a zinc salt. These zinc salts may be acidic, neutral or basic (overbased). These salts may be prepared from the reaction of a zinc containing reagent with a carboxylic acid or salt thereof. A useful method of preparation of these salts is to react zinc oxide with a carboxylic acid. Useful carboxylic acids are those described hereinabove. Suitable carboxylic acids include those of the formula RCOOH where R is an aliphatic or alicyclic hydrocarbon radical. Among these are those wherein R is a fatty group, e.g., stearyl, oleyl, linoleyl, or palmityl. Also suitable are the zinc salts wherein zinc is present in a stoichiometric excess over the amount needed to prepare a neutral salt. Salts wherein the zinc is present from 1.1 to 1.8 times the stoichiometric, e.g., 1.3 to 1.6 times the stoichiometric amount of zinc, may be used. These zinc carboxylates are known in the art and are described in U.S. Pat. No. 3,367,869. Metal salts may also include calcium salts. Examples may include overbased calcium salts.

Sulfurized olefins are also well known commercial materials used as friction modifiers. A suitable sulfurized olefin is one which is prepared in accordance with the detailed teachings of U.S. Pat. Nos. 4,957,651 and 4,959,168. Described therein is a cosulfurized mixture of 2 or more reactants selected from the group consisting of at least one fatty acid ester of a polyhydric alcohol, at least one fatty acid, at least one olefin, and at least one fatty acid ester of a monohydric alcohol. The olefin component may be an aliphatic olefin, which usually will contain 4 to 40 carbon atoms. Mixtures of these olefins are commercially available. The sulfurizing agents useful in the process of the present technology include elemental sulfur, hydrogen sulfide, sulfur halide plus sodium sulfide, and a mixture of hydrogen sulfide and sulfur or sulfur dioxide.

Metal salts of alkyl salicylates include calcium and other salts of long chain (e.g. C12 to C16) alkyl-substituted salicylic acids.

Amine salts of alkylphosphoric acids include salts of oleyl and other long chain esters of phosphoric acid, with amines such as tertiary-aliphatic primary amines, sold under the tradename Primene™.

The amount of the supplemental friction modifier, if it is present, may be 0.1 to 1.5 percent by weight of the lubricating composition, such as 0.2 to 1.0 or 0.25 to 0.75 percent. In some embodiments, however, the amount of the supplemental friction modifier is present at less than 0.2 percent or less than 0.1 percent by weight, for example, 0.01 to 0.1 percent.

The compositions of the present technology can also include a detergent. Detergents as used herein are metal salts of organic acids. The organic acid portion of the detergent may be a sulfonate, carboxylate, phenate, or salicylate. The metal portion of the detergent may be an alkali or alkaline earth metal. Suitable metals include sodium, calcium, potassium, and magnesium. Typically, the detergents are overbased, meaning that there is a stoichiometric excess of metal base over that needed to form the neutral metal salt.

Suitable overbased organic salts include the sulfonate salts having a substantially oleophilic character and which are formed from organic materials. Organic sulfonates are well known materials in the lubricant and detergent arts. The sulfonate compound should contain on average 10 to 40 carbon atoms, such as 12 to 36 carbon atoms or 14 to 32 carbon atoms on average. Similarly, the phenates, salicylates, and carboxylates have a substantially oleophilic character.

While the present technology allows for the carbon atoms to be either aromatic or in paraffinic configuration, in certain embodiments alkylated aromatics are employed. While naphthalene based materials may be employed, the aromatic of choice is the benzene moiety.

Suitable compositions thus include an overbased monosulfonated alkylated benzene such as a monoalkylated benzene. Alkyl benzene fractions may be obtained from still bottom sources and are mono- or di-alkylated. It is believed, in the present technology, that the mono-alkylated aromatics are superior to the dialkylated aromatics in overall properties.

It is desired that a mixture of mono-alkylated aromatics (benzene) be utilized to obtain the mono-alkylated salt (benzene sulfonate) in the present technology. The mixtures wherein a substantial portion of the composition contains polymers of propylene as the source of the alkyl groups assist in the solubility of the salt. The use of mono-functional (e.g., mono-sulfonated) materials avoids crosslinking of the molecules with less precipitation of the salt from the lubricant.

The salt may be "overbased." By overbasing, it is meant that a stoichiometric excess of the metal base be present over that required for the anion of the neutral salt. The excess metal from overbasing has the effect of neutralizing acids which may build up in the lubricant. Typically, the excess metal will be present over that which is required to neutralize the anion at in the ratio of up to 30:1, such as 5:1 to 18:1 on an equivalent basis.

The amount of the overbased salt utilized in the composition is typically 0.025 to 3 weight percent on an oil free basis, such as 0.1 to 1.0 percent. In other embodiments, the final lubricating composition may contain no detergent or substantially no detergent or only a low amount of detergent. That is, for a calcium overbased detergent for instance, the amount may be such as to provide less than 250 parts per million calcium, e.g., 0 to 250 or 1 to 200 or 10 to 150 or 20 to 100 or 30 to 50 parts per million calcium, or less than any of the foregoing non-zero amounts. This is in contrast with more conventional formulations which may contain sufficient calcium detergent to provide 300 to 600 ppm calcium. The overbased salt is usually made in up to about 50% oil and has a TBN range of 10-800 or 10-600 on an oil free basis. Borated and non-borated overbased detergents are described in U.S. Pat. Nos. 5,403,501 and 4,792,410.

The compositions of the present technology can also include at least one phosphorus acid, phosphorus acid salt, phosphorus acid ester or derivative thereof including sulfur-containing analogs in the amount of 0.002-1.0 weight percent. The phosphorus acids, salts, esters or derivatives thereof include phosphoric acid, phosphorous acid, phosphorus acid esters or salts thereof, phosphites, phosphorus-containing amides, phosphorus-containing carboxylic acids or esters, phosphorus-containing ethers, and mixtures thereof.

In one embodiment, the phosphorus acid, ester or derivative can be an organic or inorganic phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids. One group of phosphorus compounds are alkylphosphoric acid mono alkyl primary amine salts as represented by the formula

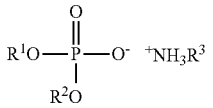

where $R^1$, $R^2$, $R^3$ are alkyl or hydrocarbyl groups or one of $R^1$ and $R^2$ can be H. The materials are usually a 1:1 mixture of dialkyl and monoalkyl phosphoric acid esters. Compounds of this type are described in U.S. Pat. No. 5,354,484.

Eighty-five percent phosphoric acid is a suitable material for addition to the fully-formulated compositions and can be included at a level of 0.01 to 0.3 weight percent based on the weight of the composition, such as 0.03 to 0.2 or to 0.1 percent. The phosphoric acid may form a salt with a basic component such as a succinimide dispersant.

Other phosphorus-containing materials that may be present include dialkylphosphites (sometimes referred to as dialkyl hydrogen phosphonates) such as dibutyl phosphite. Yet other phosphorus materials include phosphorylated hydroxy-substituted triesters of phosphorothioic acids and amine salts thereof, as well as sulfur-free hydroxy-substituted di-esters of phosphoric acid, sulphur-free phosphorylated hydroxy-substituted di- or tri-esters of phosphoric acid, and amine salts thereof. These materials are further described in U.S. patent application US 2008-0182770.

Other materials can optionally be included in the compositions of the present technology, provided that they are not incompatible with the aforementioned required components or specifications. Such materials include antioxidants (that is, oxidation inhibitors), including hindered phenolic antioxidants, secondary aromatic amine antioxidants such as dinonyldiphenylamine as well as such well-known variants as monononyldiphenylamine and diphenylamines with other alkyl substituents such as mono- or di-octyl, sulfurized phenolic antioxidants, oil-soluble copper compounds, phosphorus-containing antioxidants, and organic sulfides, disulfides, and polysulfides such as 2-hydroxyalkyl, alkyl thioethers or 1-t-dodecylthio-2-propanol or sulfurized 4-carbobutoxycyclohexene or other sulfurized olefins. Also included may be corrosion inhibitors such as tolyl triazole and dimercaptothiadiazole and oil-soluble derivatives of such materials. Other optional components include seal swell compositions, such as isodecyl sulfolane or phthalate esters, which are designed to keep seals pliable. Also permissible are pour point depressants, such as alkylnaphthalenes, polymethacrylates, vinyl acetate/fumarate or /maleate copolymers, and styrene/maleate copolymers. Other materials are an anti-wear agents such as zinc dialkyldithiophosphates, tridecyl adipate, and various long-chain derivatives of hydroxy carboxylic acids, such as tartrates, tartramides, tartrimides, and citrates as described in US Application 2006-0183647. These optional materials are known to those skilled in the art, are generally commercially available, and are described in greater detail in published European Patent Application 761,805. Also included can be known materials such as corrosion inhibitors (e.g., tolyltriazole, dimercaptothiadiazoles), dyes, fluidizing agents, odor masking agents, and antifoam agents. Organic borate esters and organic borate salts can also be included.

The above components can be in the form of a fully-formulated lubricant or in the form of a concentrate within a smaller amount of lubricating oil. If they are present in a concentrate, their concentrations will generally be directly proportional to their concentrations in the more dilute form in the final blend.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this technology, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this technology, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present technology in its intended use, may not be susceptible of easy description. Nevertheless, all such modifications and reaction products are included within the scope of the present technology; the present technology encompasses the composition prepared by admixing the components described above.

EXAMPLES

Preparative Example A

Synthesis of the material represented by structure (I) above: Tartrimide of Duomeen 2HT™. DL-Tartaric acid, 96.9 g and xylene, 1050 mL, are combined with stirring under a nitrogen atmosphere. The mixture is heated to 140° C., and to this, Duomeen 2HT™ (N,N-ditallowamino-propylamine), 376.6 g is added over about 12 hours. The mixture is then heated at 140° C. and stirred for 11 hours, removing volatiles by distillation. The mixture is allowed to cool. Any remaining solvent is removed under reduced pressure using a rotary evaporator.

Preparative Example B

Malimide of Duomeen 2HT™. Malic acid, 74.5 g of malic acid and 250 mL toluene are mixed in a 1 L flask. The mixture is heated to 110° C. and 324.3 g Duomeen 2HT is added dropwise over a period of 6 hours by an addition funnel. The mixture is stirred for a further 2 hours at 110° C., then heated to about 115° C. for at least 16 hours. The solvent is removed under vacuum (2.67 Pa, 20 mm Hg) over 2 hours at 110° C.

Preparative Example C

Duomeen 2HT™ tartaric di-amide. Duomeen 2HT, 502.7 g, and xylene, 100 mL, are combined with stirring under a nitrogen atmosphere. This mixture is heated to 170° C. and to this tartaric acid, 72.5 g, is added (via a solids addition hopper) over approximately 3.5 hours. The mixture is then heated at 170° C. and stirred for 7 hours, removing volatiles by distillation. The mixture is then allowed to cool. Any remaining solvent is removed under reduced pressure using a rotary evaporator.

Base Formulation A:

3.5% succinimide dispersant(s) (containing about 41.5% oil)

0.2% dibutyl phosphite 0.1% phosphoric acid 0.9% amine antioxidant 0.4% seal swell agent 0.2% pour point depressant 9.5% dispersant viscosity modifier (containing 25% oil)

0.01% other minor components balance: mineral oils (predominantly 3-6 cSt)

Lubricants for testing are prepared by adding one of the test materials identified in the tables below, to the indicated base formulation. The resulting lubricants are subjected to a VSFT test, which is a variable speed friction test. The VSFT apparatus consists of a disc that can be metal or another friction material which is rotated against a metal surface. The friction materials employed in the particular tests are various commercial friction materials commonly used in automatic transmission clutches, as indicated in the Tables. The test is run over three temperatures and two load levels. The coefficient of friction measured by the VSFT is plotted against the sliding speed (50 and 200 r.p.m.) over a number speed sweeps at a constant pressure. The results are initially presented as slope of the μ-v curve as a function of time, reported for 40, 80, and 120° C. and 24 kg and 40 kg (235 and 392 N) force, determined at 4 hour intervals from 0 to 52 hours. Typically, the slope will initially be positive, with a certain amount of variability, and may gradually decrease, possibly becoming negative after a certain period of time. Longer duration of positive slope is desired.

The data is initially collected as a table of slope values as a function of time, for each run. For ease of analysis and comparison, each formulation at each temperature is assigned a "slope score." At each temperature, the fraction of slope values within the first 7 time measurements (0 to 24 hours) at 24 kg and of the first 7 measurements at 40 kg (thus 14 measurements total) that are positive, as a percent, is denoted as "A". The fraction of the slope values at the two pressures (14 measurements total) within the second 24 hours (28-52 hours) that are positive are denoted as "B". The slope score is defined as A+2B. The extra weighting given to the latter portion of the test is to reflect the greater importance (and difficulty) of preparing a durable fluid that retains a positive slope in the latter stages of the test. The maximum score of 300 denotes a fluid that exhibits a consistently positive slope through the entire test. For illustration, the individual slope results for Preparative Example A at 0.25% in Formulation A are presented below, along with the "slope score."

Preparative Example A 0.25%, 40° C., Formulation A

| Time, hr | μ-V Slope, 24 kg | μ-V Slope, 40 kg | | Slope Score (A + 2B) |
|---|---|---|---|---|
| 0 | −0.009 | −0.010 | A = 0/14 = 0% | 0 + 2 × 7.14 = 14.28 |
| 4 | −0.012 | −0.003 | | |
| 8 | −0.019 | −0.009 | | |
| 12 | −0.021 | −0.004 | | |
| 16 | −0.020 | −0.004 | | |
| 20 | −0.021 | 0.003 | | |
| 24 | −0.016 | −0.010 | | |
| 28 | −0.015 | +0.002 | B = 1/14 = 7.14% | |
| 32 | −0.014 | −0.001 | | |
| 36 | −0.012 | 0.000 | | |
| 40 | −0.011 | −0.008 | | |
| 44 | −0.012 | −0.006 | | |
| 48 | −0.013 | −0.013 | | |
| 52 | −0.017 | −0.009 | | |

A summary of the "slope scores" for certain of the materials of the above preparative examples is provided in the table below:

| | | | Base | | Slope Score | | |
|---|---|---|---|---|---|---|---|
| Ex. | Prep. Ex. | Treat, % | Formulation | Friction Mat'l[a] | 40° C. | 80° C. | 120° C. |
| 1 | A (imide) | 0.25 | A | 4211 | 14 | 79 | 214 |
| 2 | A | 0.5 | A | 4211 | 21 | 114 | 271 |
| 3 | A | 1.0 | A | 4211 | 136 | 286 | 300 |
| 4 | A | 2.5 | A | 4211 | 271 | 300 | 300 |
| 5 | A | 2.5 | A | 4211 | 243 | 243 | 286 |
| 6[b] | none | 0 | A | 4211 | 0 | 14 | 200 |
| 7[b] | OT[d] | 0.25 | A | 4211 | 0 | 14 | 286 |
| 8[b] | OT[d] | 0.5 | A | 4211 | 0 | 57 | 271 |
| 9[b] | OT[d] | 1.0 | A | 4211 | 29 | 79 | 107 |
| 10 | C (diamide) | 2.5 | A | 6100 | 157 | 200 | 214 |
| 11[b] | none | 0 | A | 6100 | 0 | 21 | 129 |

[a]Friction materials: Raybestos ™ 4211 or Borg Warner ™ 6100
[b]A reference example
[d]Oleyl tartrimide The results show desirable frictional performance by materials of the present technology, in particular as compared to the base formulation from which they are absent. The results also indicate that better performance is sometimes obtained at relatively higher concentrations of 0.5 percent or greater, e.g., 1.0 or 2.5% compared with 0.25%. Performance is also superior to a reference material, oleyl tartrimide.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the technology can be used together with ranges or amounts for any of the other elements. As used herein, the expression "consisting essentially of" permits the inclusion of substances that do not materially affect the basic and novel characteristics of the composition under consideration.

What is claimed is:

1. A method for lubricating an automatic transmission, comprising supplying thereto:

(a) an oil of lubricating viscosity and (b) a composition comprising a condensation product of a hydroxy-polycarboxylic acid or mixtures thereof or a reactive equivalent thereof, with an N,N-di(hydrocarbyl) alkylenediamine;

wherein the condensation product comprises a material represented by

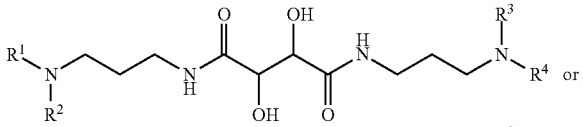

or

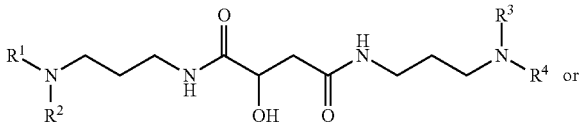

or

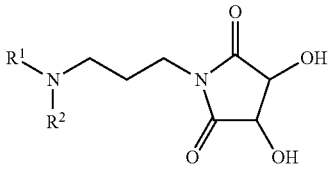

or

-continued

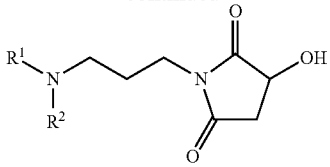

or mixtures thereof;

wherein each of $R^1$, $R^2$, $R^3$, and $R^4$ is independently an alkyl group of 1 to about 22 carbon atoms, provided that the total number of carbon atoms in $R^1$ and $R^2$ is at least about 13 and the total number of carbon atoms in $R^3$ and $R^4$ is at least about 13.

2. The method of claim 1 wherein the condensation product comprises a diamide or an imide or mixtures thereof.

3. The method of claim 1 wherein $R^1$, $R^2$, $R^3$, and $R^4$ are alkyl groups characteristic of tallowamine or cocoamine.

4. The method of claim 1 wherein the acid forming the condensation product comprises tartaric acid.

5. The method of claim 1 wherein the amine forming the condensation product comprises an N,N-dialkyl-1,3-propanediamine.

6. The method of claim 1 wherein the amount of the condensation product is about 0.05 to about 10 weight percent.

7. The method of claim 1, wherein the composition further comprises further comprising at least one further additive selected from the group consisting of dispersants, detergents, antioxidants, seal swell agents, and anti-wear agents.

8. The method of claim 1, wherein the composition further comprises further comprising at least one additive selected from the group consisting of organic borate esters, organic borate salts, organic phosphorus esters, organic phosphorus salts, inorganic phosphorus acids, and inorganic phosphorus salts.

* * * * *